US007384037B2

(12) United States Patent
Sawayama et al.

(10) Patent No.: US 7,384,037 B2
(45) Date of Patent: Jun. 10, 2008

(54) SHEET HANDLING MACHINE

(75) Inventors: Hideyuki Sawayama, Oumihachiman (JP); Daisuke Tokunaga, Ohtsu (JP); Shunsuke Hayashi, Ohtsu (JP); Sho Mizuno, Ohtsu (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 166 days.

(21) Appl. No.: 11/068,435

(22) Filed: Mar. 1, 2005

(65) Prior Publication Data

US 2005/0200072 A1 Sep. 15, 2005

(30) Foreign Application Priority Data

Mar. 2, 2004 (JP) ..... 2004-057542

(51) Int. Cl.
*B65H 31/00* (2006.01)

(52) U.S. Cl. ..... 271/207; 414/788.9

(58) Field of Classification Search ..... 271/207, 271/171, 3.01, 223, 220; 414/788.9
See application file for complete search history.

(56) References Cited

U.S. PATENT DOCUMENTS 3,907,128 A * 9/1975 Cathers ..... 414/788.9
4,828,246 A * 5/1989 Wegel et al. ..... 271/182
5,374,051 A * 12/1994 Ulrich et al. ..... 271/222
7,029,008 B2 * 4/2006 Nishida et al. ..... 271/223

FOREIGN PATENT DOCUMENTS

JP 2001-101479 4/2001

* cited by examiner

*Primary Examiner*—Kaitlin Joerger
(74) *Attorney, Agent, or Firm*—Mattingly, Stanger, Malur & Brundidge, P.C.

(57) ABSTRACT

A sheet housing part of a sheet handling machine is provided with a guide member for adjusting a size of a housing space of the sheet housing part. A tip end part of the guide member is made pivotable, and is provided with a biasing member for swinging the tip end part in a direction of a side wall of the sheet housing part. A gap provided between the guide member and an inner wall of the sheet housing part is closed with this construction, and thereby, a foreign matter is prevented from entering this gap.

4 Claims, 3 Drawing Sheets

SHEET HANDLING MACHINE

INCORPORATION BY REFERENCE

The present application claims priority from Japanese application JP2004-057542 filed on Mar. 2, 2004, the content of which is hereby incorporated by reference into this application.

BACKGROUND OF THE INVENTION

The present invention relates to a sheet handling machine for handling sheets such as banknotes, and particularly to a sheet handling machine having a sheet housing part in which the size of a housing space for piling up and housing sheets is adjustable in accordance with the size of the sheets which are handled.

PRIOR ART

Banknote handling machines for handling banknotes relating to transactions of deposits and withdrawals, for example, an automated-teller machine (ATM) and a cash dispenser (CD) are conventionally placed at the branches of financial institutions such as banks. The sheet handling machine is provided with a banknote introducing part for introducing banknotes which users deposit, and a plurality of sheet housing parts for piling up and housing banknotes, such as banknote cartridges for housing banknotes introduced into a body or banknotes to be withdrawn by the users. The banknote handling machine, as is generally known, pays out the sheets housed in the banknote introducing part and the banknote housing part such as a sheet cartridge one by one and transfers them, and determines the banknotes as true or false and denominations of the banknotes in the sheet identifying part and confirms the deposit amount and withdrawal amount, thereby handling the transactions.

Unless the banknotes are housed in the sheet housing part by being aligned, a so-called jam in which the banknote paid out of the banknote housing part is skewed and gets jammed in the transfer passage rises, which reduces the reliability of the machine body. In other words, in order not to reduce the reliability of the machine body, it is necessary to house the banknotes in the banknote housing part by aligning them. In order to pile up the banknotes by aligning them, the width dimension of the housing space (space in which the banknotes are piled up and housed) of the banknote housing part is set to be the size corresponding to the size of the banknotes to be housed. As the prior art document showing this kind of art, JP-A-2001-101479 is cited. In the banknote handling machine of the prior art document, a plate-like guide member (guide member of which mounting position is adjustable in the width direction of the housing space) capable of adjusting the width dimension of the housing space of the banknotes is mounted to the banknote housing part, considering that the banknote size differs for each denomination.

The above described prior art has the problem that a foreign matter enters a gap between an outer side (opposite side of the housing space) of the guide member and an inner wall of the banknote housing part, and brings the machine body out of order.

SUMMARY OF THE INVENTION

An object of the present invention is to solve the problem of the above described prior art and provide a sheet handling machine which reduces failure by preventing a matter from getting in between a guide member provided at a sheet housing part to be capable of adjusting a size of a housing part and a side wall of the sheet housing part.

In order to attain the above described object, according to the present invention, there is provided a sheet handling machine including a sheet housing part for piling up and housing sheets, by including a guide member mounted to at least one of side walls of the sheet housing part to be capable of adjusting a size of a housing space of the sheet housing part, wherein the guide member includes a mechanism for closing a gap provided between the guide member and the side wall of the above described housing part.

With this construction, the guide member can adjust the size of the housing part, and therefore, the housing space corresponding to the banknote of an optional denomination can be easily obtained, and failure due to inclusion of a foreign matter between the housing part and the guide member can be reduced.

More specifically, the guide member has the construction including an upright member vertically provided at a bottom surface of the above described sheet housing part toward a top surface from which banknotes to be housed come in, a turning member turnably mounted to an upper end portion of the upright member, and a biasing member for exerting a swinging force turning to a side of the side wall onto the turning member. The turning member turns to the side of the side wall of the sheet housing part by the biasing force by the biasing member. Since the turning member stops in the state in which its tip end abuts to the side wall of the sheet housing part, a top surface of a gap is closed by the turning member even if the gap is provided between the upright member mounted with this swinging member and the side wall of the sheet housing part, and therefore, a foreign matter can be prevented from entering this gap.

The above described biasing member is constructed by an elastic member for connecting the above described upright member provided at a side of the side wall, and the swinging member, whereby the swinging force turning to the side of the side wall of the sheet housing part can be exerted onto the swinging member with a simple construction, and a low-cost system can be provided.

Other objects, features and advantages of the invention will become apparent from the following description of the embodiments of the invention taken in conjunction with the accompanying drawings.

PREFERRED EMBODIMENTS OF THE INVENTION

Hereinafter, a banknote handling machine according to an embodiment of this invention will be explained.

Figure 1:
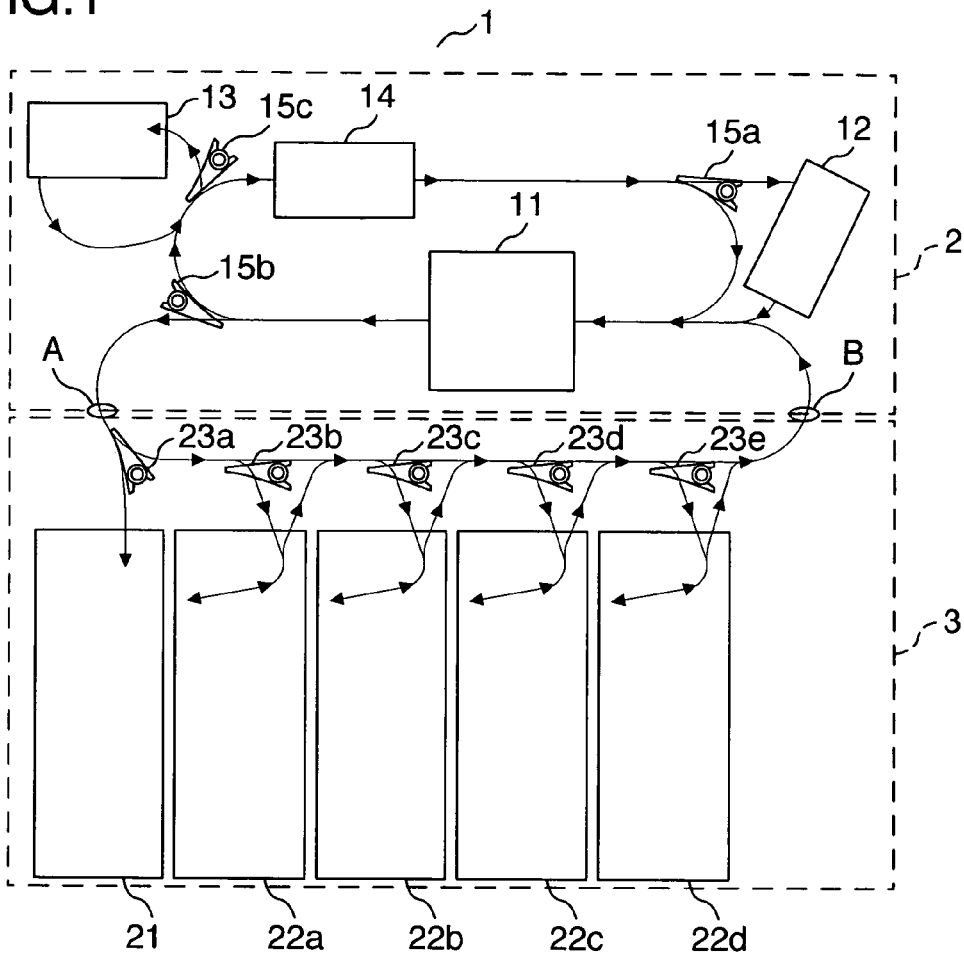
FIG. 1 is a view showing a main part of a banknote handling machine according to an embodiment of this invention.

FIG. 1 is a schematic internal sectional view showing a construction of a main part of the banknote handling machine according to an embodiment of this invention. A banknote handling machine 1 of this embodiment is constructed by an upper unit 2 and a lower unit 3 separable each other. The upper unit 2 includes a banknote identifying part 11 for determining the banknotes as true or false, denominations of the banknotes and the like, a deposit and withdrawal port 12 into which users input banknotes or from which banknotes are discharged to users, a temporary holding part 13 for temporarily holding the identified banknotes in the banknote identifying part 11, and a return holding part 14 for temporarily holding the banknotes (banknotes to be returned to the users) of which truth or falsehood and denomination cannot be determined in the banknote identifying part 11 among the banknotes inputted into the banknote introducing port 12 by the users. The lower unit 3 includes a recovering cartridge 21 for recovering banknotes and the like which the user forgets to take, and a cartridge 22 (22*a* to 22*d*) distinguished by denominations for housing the banknotes provided in accordance with denominations. For example, the cartridge 22*a* houses thousand-yen notes, the cartridge 22*b* houses five thousand-yen notes and the cartridges 22*c* and 22*d* house ten thousand-yen notes.

In the upper unit 2 and the lower unit 3, banknote transfer passages for transferring the banknotes in the direction shown in the drawing are formed. The banknote transfer passages are connected at a point A where the banknotes are transferred to the lower unit 3 from the upper unit 2, and a point B where the banknotes are transferred to the upper unit 2 from the lower unit 3 when the upper unit 2 and the lower unit 3 are connected. The banknote transfer passage has a plurality of branch points, and each branch point is provided with a flapper for switching the destination of a banknote. A flapper 15*a* shown in the drawing switches the destination of a banknote between the banknote identifying part 11 and the deposit and withdrawal port 12, a flapper 15*b* switches the destination of a banknote between the lower unit 3, and the temporary holding part 13 or the return holding part 14, and a flapper 15*c* switches the destination of a banknote between the temporary holding part 13 and the return holding part 14. Flappers 23*a* to 23*e* which are provided at the lower unit 3 switch the transference of a banknote to the recovering cartridge 21 or the cartridge 22 (22*a* to 22*d*) by the denominations, and the transference to the upper unit 2. Further, a banknote transfer passage for transferring the banknotes paid out of the banknote cartridge 22 (22*a* to 22*d*) to the upper unit 2 is formed in the lower unit 3.

Now, a deposit transaction and a withdrawal transaction in the banknote handling machine 1 will be explained simply. First, the deposit transaction will be explained. A user inputs banknotes to be deposited into the deposit and withdrawal port 12. The banknote handling machine 1 pays out the banknotes inputted into the deposit and withdrawal port 12 one by one, and transfers them to the banknote identifying part 11. In the banknote identifying part 11, truth or falsehood, and denominations are determined for each transferred banknote. The banknote identified in the banknote identifying part 11 is not transferred to the lower unit 3 side, but is transferred to the side of the temporary holding part 13 and the return holding part 14. The banknotes which are determined as a true note and of which denominations are determined are held in the temporary holding part 13, and the banknote at least whose truth or denomination is not identified is held in the return holding part 14. Switching of the transfer destination of the banknotes in the banknote transfer passage is performed by switching of the flappers 15*b* and 15*c*.

When the banknote handling machine 1 identifies all the banknotes inputted into the deposit and withdrawal port 12 in the banknote identifying part 11, it pays out the banknotes held in the return holding part 14 this time one by one, and transfers them to the deposit and withdrawal port 12. When the banknote handling machine 1 transfers all the banknotes held in the return holding part 14 this time to the deposit and withdrawal port 12, it switches the flapper 15*a*, and pays out the banknotes held in the temporary storing part 13 this time one by one, transfers them to the banknote identifying part 11 again, and determines truth or falsehood and denominations of them. The banknote handling machine 1 does not transfer banknotes which are identified again in the banknote identifying part 11 to the side of the temporary holding part 13 and the return holding part 14, but transfers them to the side of point A. Switching of the transfer destination of the banknotes can be performed by switching of the flapper 15*b*. The banknote handling machine 1 transfers each banknote to the cartridges 22*a* to 22*d* distinguished by denominations in accordance with the denomination when each banknote is identified again, and the banknote at least whose truth or denomination is not identified when it is identified again is transferred to the recovering cartridge 21. At this time, the banknote handling machine 1 controls the flappers 23*a* to 23*e* for each banknote transferred to the lower unit 3, and transfers and houses the banknotes into the corresponding cartridges 21, 22*a* to 22*d*.

Next, the withdrawal transaction will be explained. The withdrawal amount is inputted by a user in a display operating part not shown. The banknote handling machine 1 determines the number of banknotes to be withdrawn for each denomination based on the inputted amount to be withdrawn. The banknote handling machine 1 pays out the banknotes, of which number is determined here, one by one from the cartridges 22*a* to 22*d* distinguished by the denominations for each denomination. The banknotes paid out of the cartridges 22*a* to 22*d* distinguished by denominations are transferred to the banknote identifying part 11 at the side of the upper unit 2 via point B. In the banknote identifying part 11, truth or falsehood and denomination are determined for each transferred banknote. The banknote handling machine 1 transfers the banknote which is determined as a true note and whose denomination is determined in the banknote identifying part 11 to the temporary holding part by controlling the flappers 15*b* and 15*c*, and the banknote handling machine 1 transfers the banknote at least whose truth or denomination is not determined to the recovering cartridge 21. After the banknote handling machine 1 holds the amount of banknotes to be withdrawn this time into the temporary holding part 13, it pays out the banknotes held in the temporary holding part 13 one by one and transfers them to the deposit and withdrawal port 12. The user takes out the banknotes from this deposit and withdrawal port 12.

When the banknotes which the user forget to take out is in the deposit and withdrawal port 12, the banknote handling machine 1 pays out this banknote from the deposit and withdrawal port 12 and transfers it along the banknote transfer passage and houses it into the recovery cartridge 21.

The deposit and withdrawal port 12, the temporary holding part 13, the return holding part 14, the recovering cartridge 21 and the cartridge 22 (22*a* to 22*d*) distinguished by denominations correspond to the sheet housing part called in this invention. A pair of guide members are mounted to each of the deposit and withdrawal port 12, the temporary holding part 13, the return holding part 14, the recovery cartridge 21, and the cartridge 22 distinguished by denomination (22*a* to 22*d*). In each of the deposit and withdrawal port 12, the temporary holding part 13, the return holding part 14 and the recovery cartridge 21, a pair of guide members are mounted, with a space between them adjusted in accordance with the banknote with the largest width dimension which is handled in the machine body. In each of the cartridge 22 (22*a* to 22*d*) distinguished by denomination, a pair of guide members are mounted, with the space between a pair of guide members adjusted in accordance with the banknotes of the denominations housed therein.

Now, explanation will be made with the deposit and withdrawal port 12 to which the guide member is attached as an example. The deposit and withdrawal port 12 has a door not shown on a top surface. By opening and closing the door, input of the banknotes deposited by the users, and taking out of the banknotes to be withdrawn are limited. On a bottom surface side of the deposit and withdrawal port 12, a pickup roller for paying out the banknotes inputted into the deposit and withdrawal port 12, and a transfer roller for feeding the banknotes to be withdrawn into the deposit and withdrawal port 12 are disposed.

Figure 2:
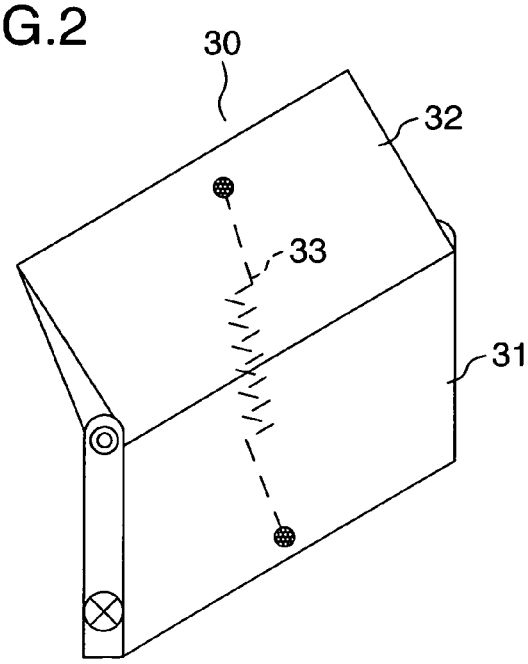
FIG. 2 is a view showing a guide member applied to the banknote handling machine which is the embodiment of this invention.
Figure 3A:
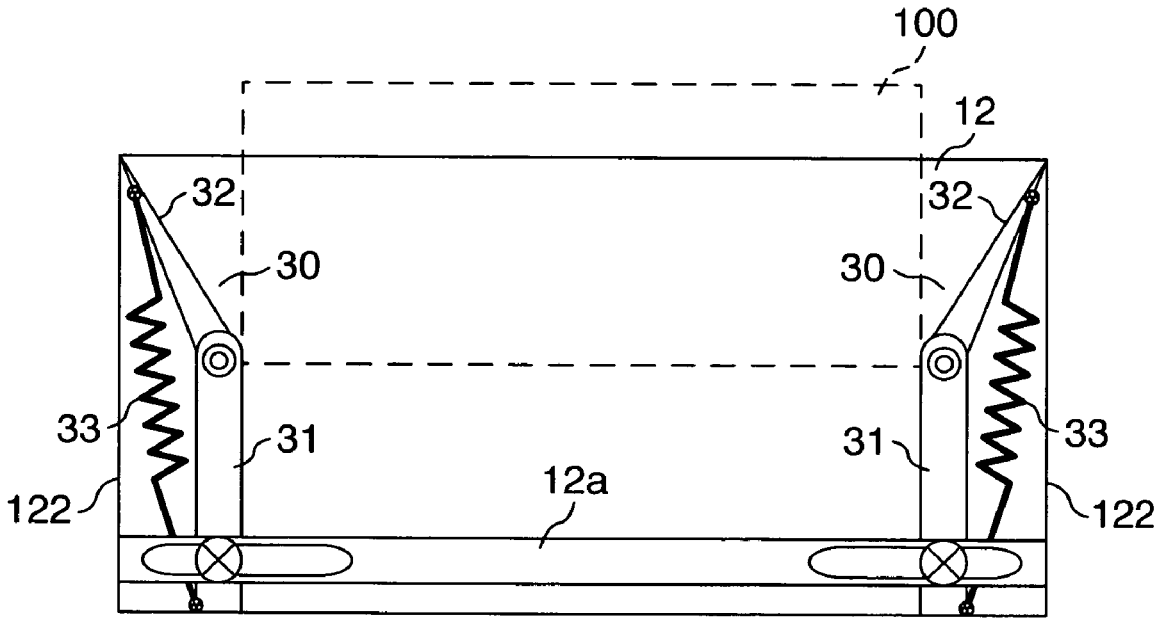
FIGS. 3A and 3B are views each showing a state in which guide members are mounted to a deposit and withdrawal port of the banknote handling machine according to the embodiment of this invention.
Figure 3B:
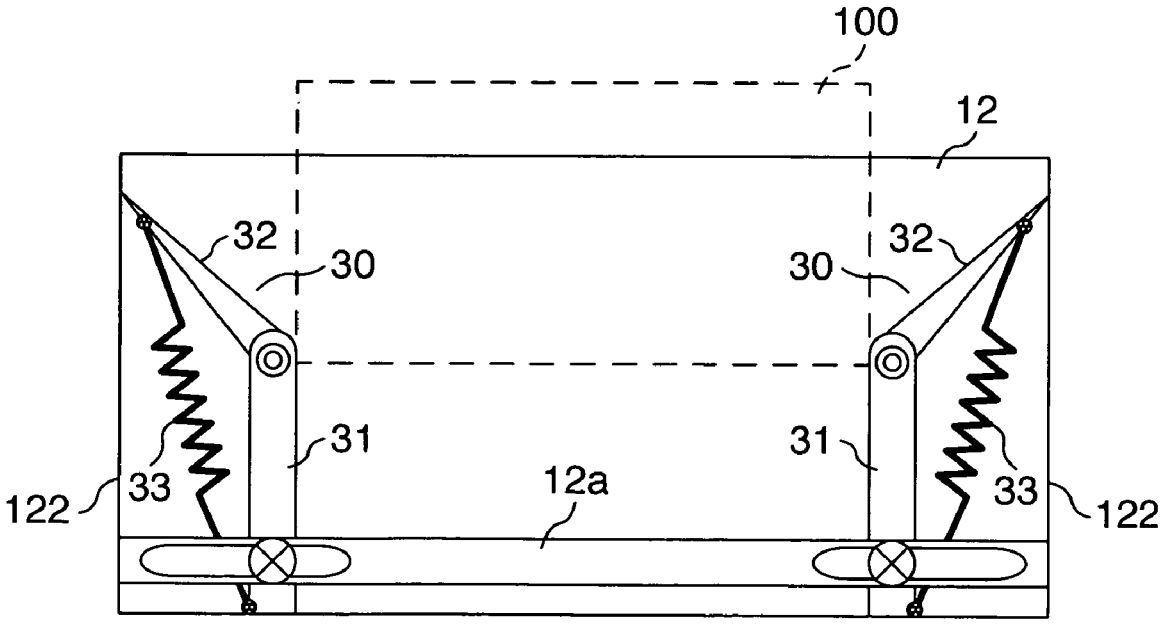

FIG. 2 is a view showing the guide member, and FIGS. 3A and 3B are views showing a state in which a pair of guide members are attached to the deposit and withdrawal port. A guide member 30 is constructed by an upright member 31 which is fixed to a mounting bar 12*a* provided at a bottom surface of the deposit and withdrawal port 12, a swinging member 32 pivotably mounted to a tip end of the upright member 31, and a spring 33 for connecting the upright member 31 and the swinging member 32 at a side of a side wall of the deposit and withdrawal port 12. The mounting bar 12*a* for mounting the guide member 30 is provided at the side of the bottom surface of the deposit and withdrawal port 12. Long holes are formed in this mounting bar 12*a* at both sides, so that the positions at which a pair of guide members 30 (upright members 31) are mounted can be adjusted in a width direction, and the space between the upright members 31 can be adjusted as shown in FIGS. 3A and 3B. The space between the upright members is determined in accordance with the width size of the banknote 100 to be housed. Accordingly, even in the machine in which different banknotes 100 with the largest width dimension are handled, the banknotes 100 can be housed by being aligned by only adjusting the space between the upright members 31.

The swinging member 32 swings to the side of the side wall 122 of the deposit and withdrawal port 12 by biasing power provided by the spring 33, and its tip end stops in the state in which it abuts to the side wall 122 of the deposit and withdrawal port 12. Accordingly, as shown in FIGS. 3A and 3B, the swinging member 32 stops in the state in which the tip end of the swinging member 32 abuts to the side wall 122 of the deposit and withdrawal port 12 irrespective of the space between the upright members 31 mounted to the deposit and withdrawal port 12 by being adjusted. Therefore, even if a gap occurs between the side wall 122 of the deposit and withdrawal port 12 and the guide member 30, the top surface of the gap is closed by the swinging member 32, and therefore, a foreign matter can be prevented from entering the gap.

In the banknote handling machine 1, not only the above described deposit and withdrawal port 12, but also the temporary holding part 13, the return holding part 14, the recovering cartridge 21 and the cartridge 22 distinguished by denomination (22*a* to 22*d*) are provided with the mounting bars with long holes formed therein so that the aforementioned pair of guide members 30 are mounted with a space corresponding to the banknotes 100 housed therein provided therebetween so that the banknotes 100 can be housed by being aligned.

Positioning holes may be formed at the mounting positions of the upright members 31 for each kind of banknote 100 in the mounting bar 12*a* instead of the long holes, and the guide member 30 may be mounted by utilizing this hole. Thereby, adjustment of the mounting positions can be facilitated at the time of mounting the guide members 30, and operability can be enhanced.

In the above described embodiment, the upright member 31 and the swinging member 32 are connected with the spring 33, but they may be connected with another elastic body such as rubber.

Figure 4A:
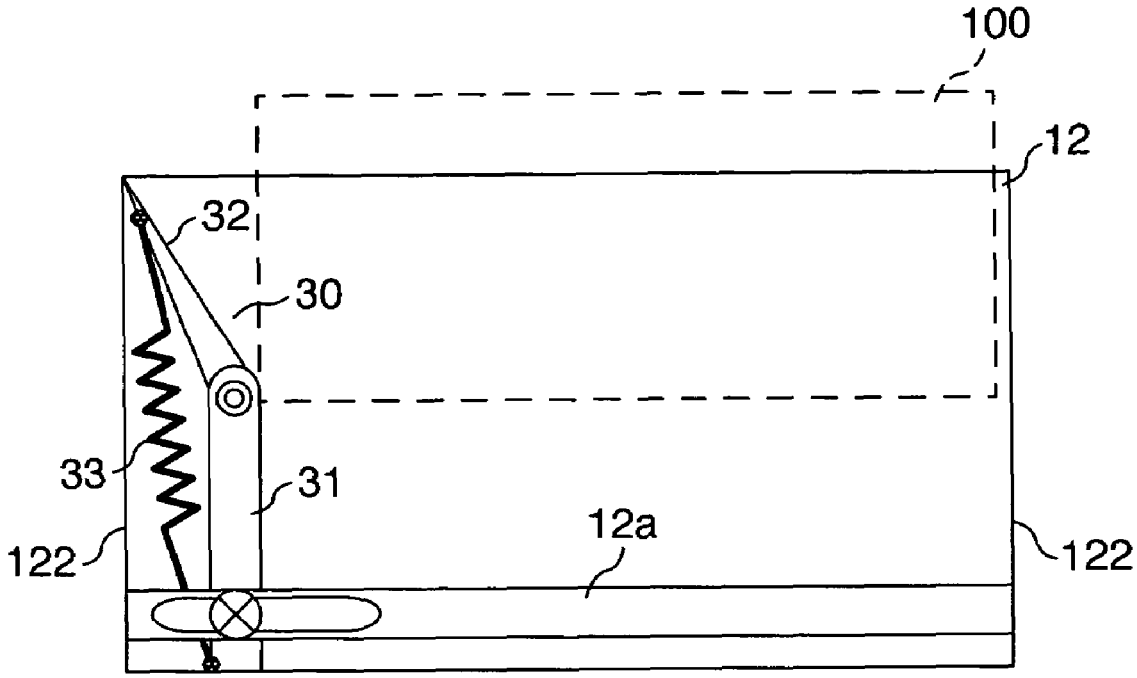
FIGS. 4A and 4B are views each showing a state in which a guide member is mounted to a deposit and withdrawal port of a banknote handling machine according to another embodiment of this invention.
Figure 4B:
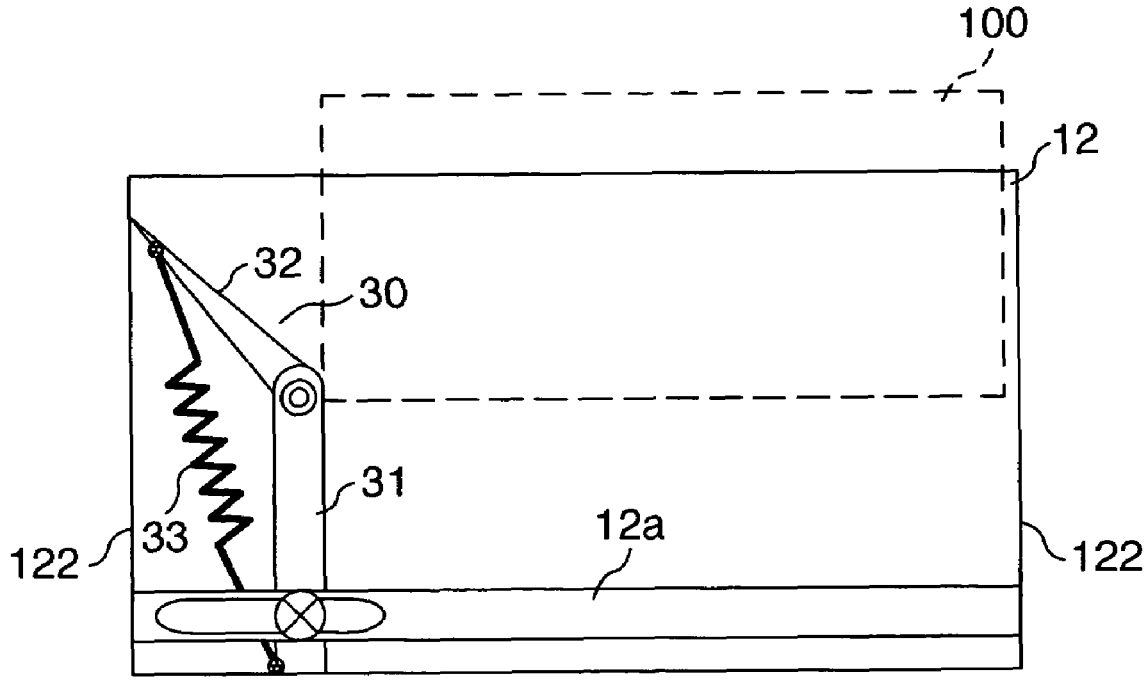

In the above described embodiment, a pair of guide members 30 are mounted with the space therebetween adjusted in accordance with the width dimension of the banknote 100 to be housed, but the construction in which one guide member 30 is mounted to one of the side walls 122 with the space from the one side wall 122 adjusted may be adopted as shown in FIGS. 4A and 4B. In this case, the same effect as the above described embodiment can be also provided, the required number of guide members 30 is reduced to half, and the machine body can be made at low cost.

The guide member in the above described embodiment has the structure of closing the gap inlet between the housing part side surface and the guide member by the construction of the upright member 31, the swinging member 32 and the spring 33, but as the alternatives to the structure of closing the gap or the gap inlet, the same effect can be expected from the structures of, for example, (1) providing the guide member with a member of which volume expands or shrinks as the size of the housing part is adjusted by the guide member, and (2) using a sliding type lid which extends to contact the housing part side surface and closes the gap inlet as the lid for closing the inlet of the gap as the size of the housing part is adjusted, for the guide member, instead of the turning type lid.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A sheet handling machine, comprising:

a sheet housing part for piling up and housing sheets deposited therein from an upper side thereof; and a guide member mounted to at least one of side walls of said sheet housing part to be capable of adjusting a size of a housing space of the sheet housing part, wherein said guide member has a mechanism for closing a gap provided between the guide member and the side wall of said housing part, wherein said guide member comprises an upright member vertically provided at a bottom surface of said sheet housing part toward a top surface from which banknotes to be housed come in, a swinging member pivotably mounted to an upper portion of the upright member, and a biasing member for exerting a swinging force swinging to a side of the side wall onto the swinging member so that a tip end of the swinging member abuts the side wall.

2. The sheet handling machine according to claim 1, wherein said guide members are provided at both side walls of said housing part.

3. The sheet handling machine according to claim 1, wherein said guide member is provided at one of the side walls of said housing part.

4. The sheet handling machine according to claim 1, wherein said biasing member is an elastic member for connecting said upright member provided at the side of the side wall, and the swinging member.

* * * * *